US011161658B2

(12) United States Patent
Wohlgenannt

(10) Patent No.: US 11,161,658 B2
(45) Date of Patent: Nov. 2, 2021

(54) CLOSURE WITH COVER CAP

(71) Applicant: Capartis AG, Schaffhausen (CH)

(72) Inventor: Herbert Wohlgenannt, Schaffhausen (CH)

(73) Assignee: CAPARTIS AG, Schaffhausen (CH)

( * ) Notice: Subject to any disclaimer, the term of this patent is extended or adjusted under 35 U.S.C. 154(b) by 91 days.

(21) Appl. No.: 16/606,165

(22) PCT Filed: Apr. 10, 2018

(86) PCT No.: PCT/EP2018/059097
§ 371 (c)(1),
(2) Date: Oct. 17, 2019

(87) PCT Pub. No.: WO2018/192797
PCT Pub. Date: Oct. 25, 2018

(65) Prior Publication Data

US 2021/0016941 A1 Jan. 21, 2021

(30) Foreign Application Priority Data

Apr. 21, 2017 (CH) ..... 00535/17

(51) Int. Cl.
*B65D 51/18* (2006.01)
*B65D 50/04* (2006.01)

(52) U.S. Cl.
CPC ..... *B65D 51/18* (2013.01); *B65D 50/046* (2013.01); *B65D 2251/0028* (2013.01); *B65D 2251/0087* (2013.01); *B65D 2251/105* (2013.01)

(58) Field of Classification Search
CPC ..... B65D 47/08; B65D 51/18; B65D 50/146; B65D 2251/0087; B65D 2251/105; B65D 455/32; B65D 50/041
(Continued)

(56) References Cited

U.S. PATENT DOCUMENTS 4,310,105 A 1/1982 Gach
5,996,859 A * 12/1999 Beck ..... B65D 47/0809 215/237

(Continued)

FOREIGN PATENT DOCUMENTS

FR 2279634 A1 2/1976

*Primary Examiner* — J. Gregory Pickett
*Assistant Examiner* — Tia Cox
(74) *Attorney, Agent, or Firm* — Steven M. Shape; Dennemeyer & Associates, LLC

(57) ABSTRACT

The closure (1) has a cover cap (2), which is retractably formed on the closure (1) by means of a hinge (3). On the sides of the closure (1) and the cover cap (2), barbs (12, 27) are formed that yield outwardly, when shutting the cover cap (2) due to bulging of the cover cap (2) transversely to the closing direction. The barbs (12) on the closure (1) thus slide over their outer edge and then engage by elastic reversal of the bulge. The cover cap (2) is then fixed onto the closure (1) in a sealing and secure manner. The cover cap (2), using its front region, rests with its edge (11) on a step (9) on the closure (1). This edge (9) is slidable onto the plane of the step (9) by pressing on the front region in the direction of the hinge (3). This creates a bilateral bulge of the lateral edges (10) of the cover cap (2) so that the barbs (26) on the cover cap (2) disengage from those (12) on the closure (1). Thereafter, the cover cap (10) can then be pivoted open about the hinge (3), by means of persistent pressure on its front region, under elastic reversal of the bulges after releasing the pressure.

12 Claims, 4 Drawing Sheets

(58) Field of Classification Search
USPC ..... 206/1.5; 222/153.1, 153.02; 215/237, 215/216
See application file for complete search history.

(56) References Cited

U.S. PATENT DOCUMENTS 6,269,986 B1 * 8/2001 Gross ..... B65D 47/0804 222/541.5
7,735,665 B2 * 6/2010 Robinson ..... B65D 47/0814 215/237
7,861,873 B1 * 1/2011 Bragg ..... B65D 50/046 215/237
8,045,263 B2 * 10/2011 Yaroslavsky ..... A61B 5/444 359/385
8,292,101 B1 * 10/2012 Bragg ..... B65D 47/0838 215/237
8,308,022 B2 * 11/2012 Barre ..... B65D 47/0828 220/847
8,505,779 B2 * 8/2013 Lilienthal ..... B65D 83/56 222/182
9,221,585 B1 * 12/2015 Wang ..... B65D 47/2037
9,382,045 B2 * 7/2016 Wohlgenannt ..... B65D 47/14
9,764,879 B2 * 9/2017 Koenigseder ..... B65D 47/0804
2003/0201283 A1 * 10/2003 Branson ..... B65D 50/046 222/153.14
2004/0069806 A1 * 4/2004 Benoit-Gonin .... B65D 47/0838 222/153.06
2005/0023285 A1 * 2/2005 Keung ..... B65D 47/0804 220/835
2005/0133475 A1 * 6/2005 Goto ..... B65D 55/02 215/237
2005/0205607 A1 * 9/2005 Hierzer ..... B65D 50/046 222/153.1
2007/0144996 A1 * 6/2007 Sawyer ..... B65D 50/046 215/235
2007/0251909 A1 * 11/2007 Decelles ..... B65D 47/0828 215/228
2008/0110933 A1 * 5/2008 Goncalves ..... B65D 47/0809 222/153.05
2008/0237236 A1 * 10/2008 Tanner ..... B65D 47/0804 220/320
2009/0152269 A1 * 6/2009 Pucci ..... B65D 47/0823 220/254.3
2014/0224802 A1 * 8/2014 Gonnert ..... B29C 45/0017 220/265
2014/0346172 A1 * 11/2014 Banerjee ..... B65D 43/22 220/257.1

* cited by examiner

CLOSURE WITH COVER CAP

CROSS-REFERENCE TO RELATED APPLICATIONS

This application is a 35 U.S.C. 371 national entry of international Application No. PCT/EP2018/059097 filed Apr. 10, 2018, which claims priority to Switzerland Application No. CH 00535/17 filed Apr. 21, 2017, which is hereby incorporated by reference in its entirety.

FIELD OF THE INVENTION

The invention relates to a closure with a cover cap. Such closures are screwed onto the necks of canisters, such as oil canisters, canisters or plastic bottles for liquid detergents and many other liquids or free-flowing goods. The closure screwed onto the neck then forms a spout and after pivoting open the related cover cap, a uniform jet of liquid or free-flowing product can be poured out or dispensed in a controlled manner. In the case of plastic closures, the cover caps on such closures are held on the closure by means of a hinge. The hinges may be designed to hold the pivoted-open cover flap in the open position. When the cover cap is pivoted down, it must be pivoted over a maximum tension of the hinge, after which the cover cap pivots down and the last few degrees of angle for pivoting closed into the closed position are overcome by pressure from above on the cover flap. There are barbs, ribs, or grooves on the inner side of the cover cap, which interact with barbs, ribs, or grooves on the closure so that the cover cap engages on the closure in its closed position and holds it thereon.

BACKGROUND OF THE INVENTION

The cover cap functions to prevent anything from falling through the closure into the container when the canister or container is not in use and, on the other hand, to prevent any content being spilled accidentally, that is the closure is tightly closed. Many millions of examples of such closures exist on respective canisters and containers.

However, these conventional closures and their respective cover caps have the disadvantage that the cover caps often jump open if the containers or bottles fall over because the impact sustained by them when hitting the ground leads to a release of the tight grip with the closure. The barbs, ribs, or grooves are designed so that they easily yield when shutting the cover cap and can thus pass each other, after which they then hook onto each other. To release, the grip is overcome by increased tensile force for pivoting open the cover cap. Many such cover caps are held on the closure with a relatively weak grip, or at the other extreme they grip too strongly to it so that it is hard to pivot open the cover cap, at least for persons with limited strength in their hands. A further disadvantage of many known cover caps is also that they can be easily pivoted open by toddlers, which would preferably be prevented to avoid toddlers being able to drink from such bottles or spill their contents.

SUMMARY

The object of this invention is therefore to provide a closure with a cover cap which easily engages with the closure when pivoting closed the cover cap onto said closure and is then held securely on the closure in the closed position so that, even when the container equipped therewith falls or drops to the floor, the cover cap does not pop open, and cannot be opened with one hand by a mere pivoting movement with sufficient force.

This object is achieved by a closure with a cover cap which is moulded pivotably onto the closure by means of a hinge and which detachably grips to, or engages with, the closure at at least two points when pivoting closed, characterised in that the cover cap is deformable by pressure at only a single point so that the grips are detachable by this deformation and the cover cap can be pivoted open beyond the gripping means with one hand in the event of continued pressure.

BRIEF DESCRIPTION OF THE FIGURES

In the figures, an exemplary embodiment of such a closure with cover cap is depicted and it is described hereinafter and its function will be explained.

BRIEF DESCRIPTION OF THE DRAWINGS

Figure 1:
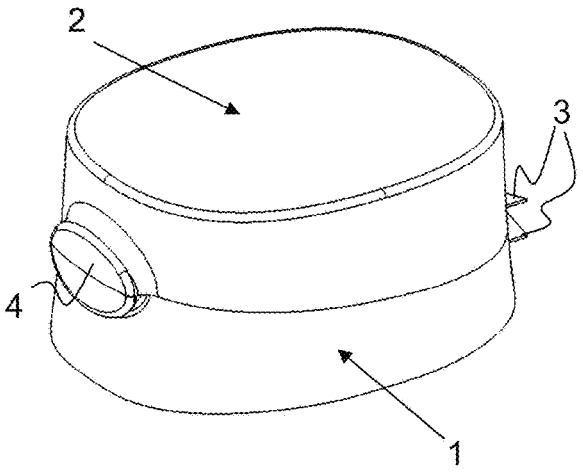
Figure 2:
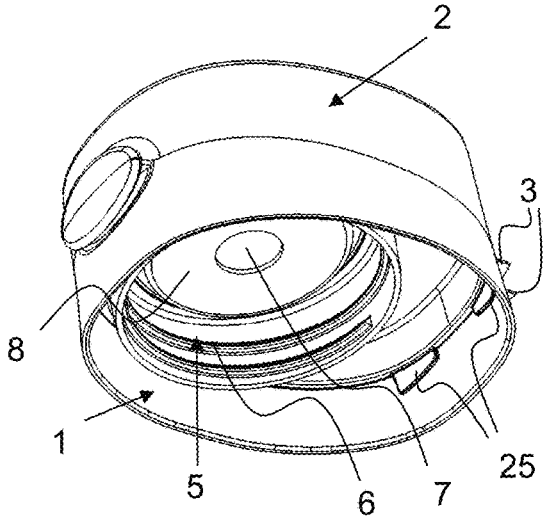
Figure 3:
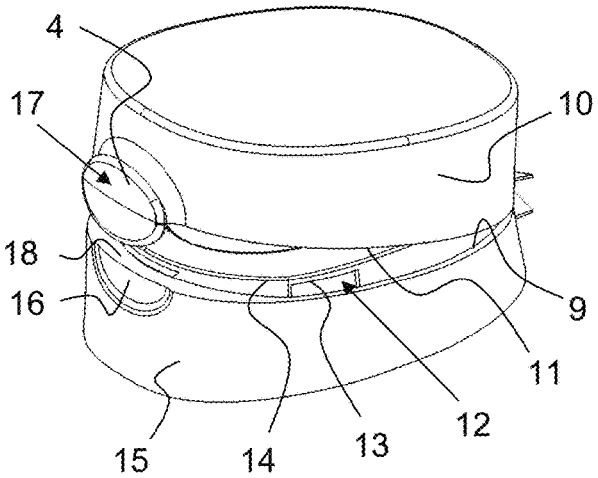
Figure 4:
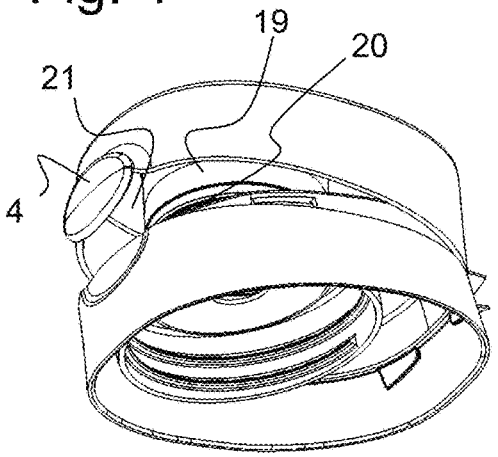
Figure 5:
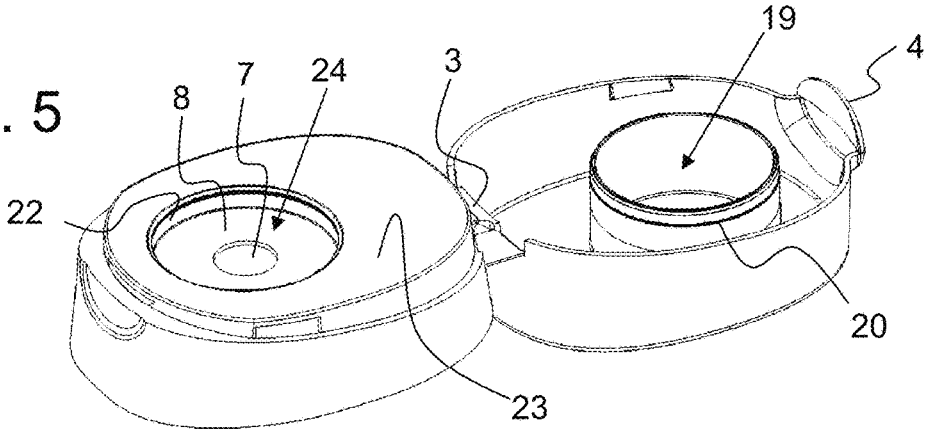
Figure 6:
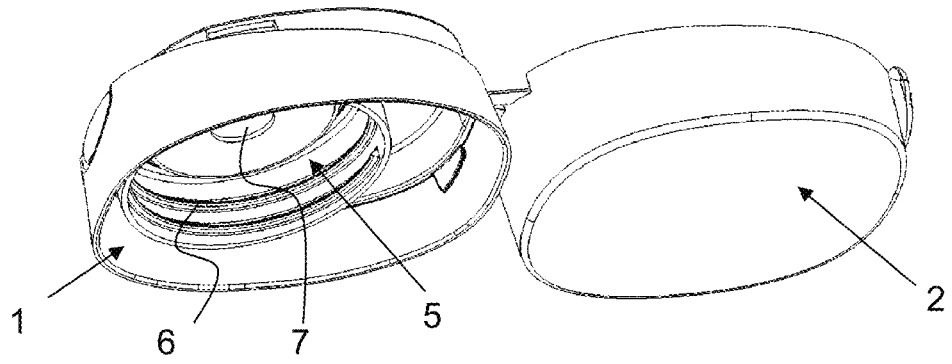
Figure 7:
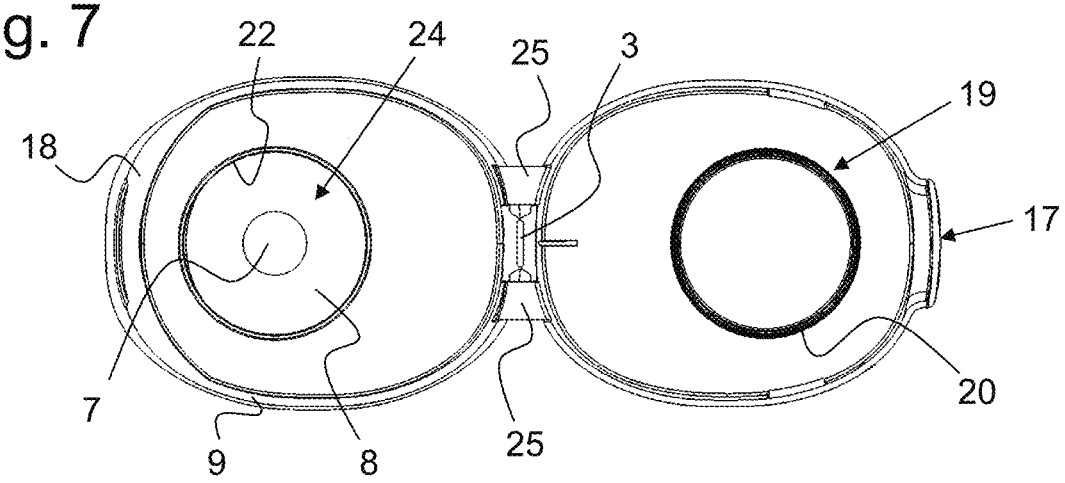
Figure 8:
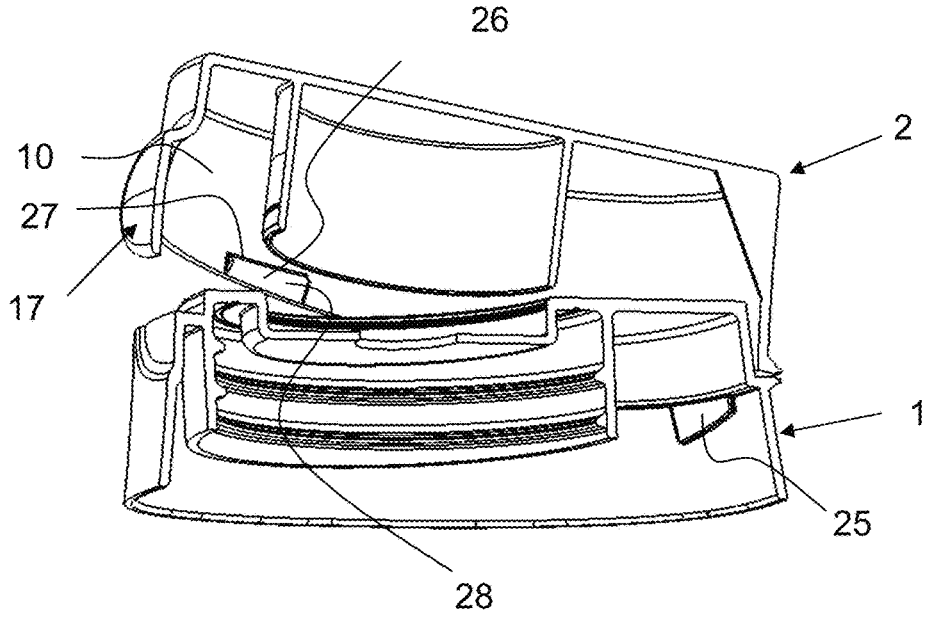
Figure 9:
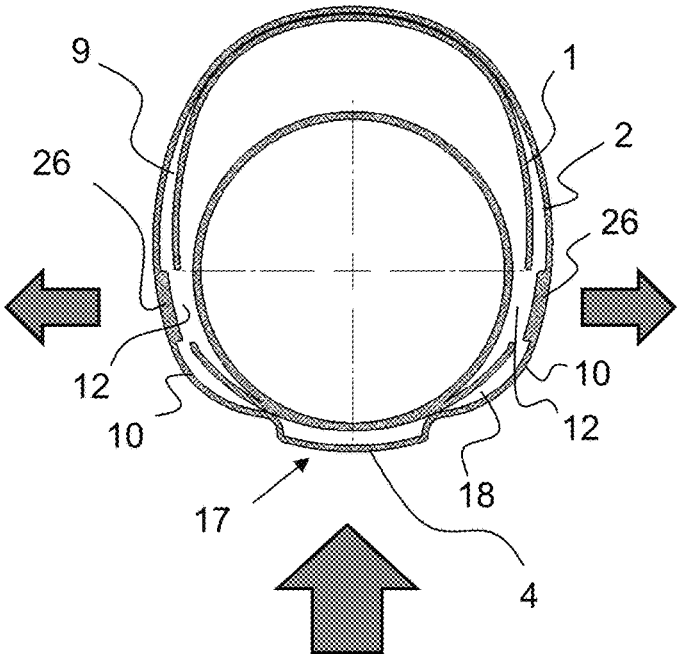
Figure 10:
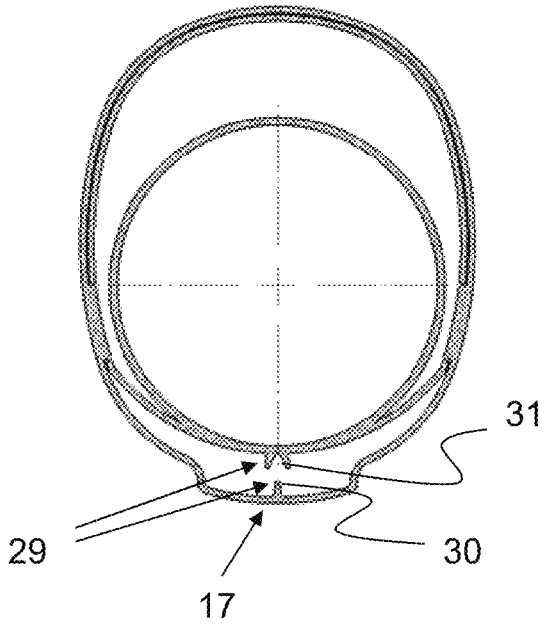
Figure 11:
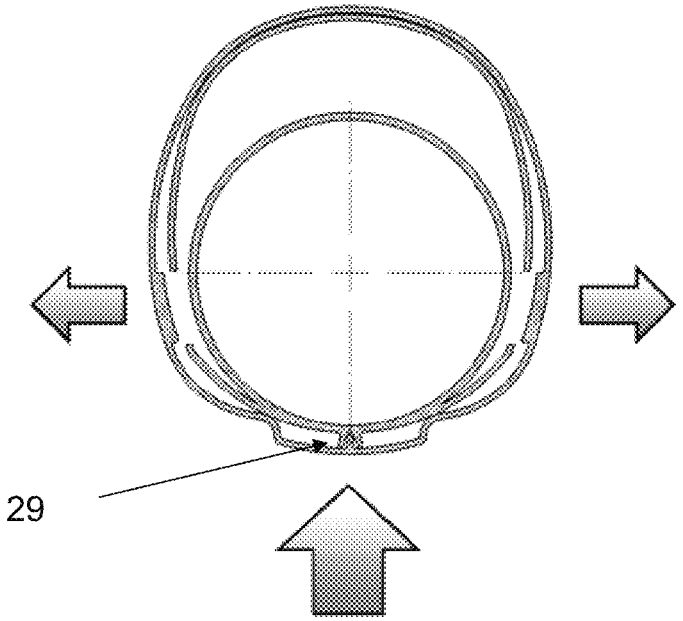

FIG. 1: shows the closure with closed cover cap;

FIG. 2: shows the closure with closed cover cap, viewed at an angle from below;

FIG. 3: shows the closure with the cover cap slightly pivoted open, with released grip of the barbs;

FIG. 4: shows the closure with the cover cap slightly pivoted open, with released grip of the barbs, viewed at an angle from below;

FIG. 5: shows the closure with the cover cap pivoted open by 180°;

FIG. 6: shows the closure with the cover cap pivoted open by 180°, viewed at an angle from below;

FIG. 7: shows the closure with the cover cap pivoted open by 180° in a plan view;

FIG. 8: shows the closure with the cover cap pivoted open slightly in a central longitudinal section;

FIG. 9: shows a schematic representation of the cover and closure in a horizontal section in a top view;

FIG. 10: shows a schematic representation of the cover and closure in a horizontal section in a top view, with a centring device;

FIG. 11: shows the schematic representation of the cover and closure of FIG. 10 with closed centring device.

DETAILED DESCRIPTION OF THE INVENTION

Between the cap and the cover cap, engaging or gripping means act so that these two or more parts engage with, or grip into, each other when shutting the cover cap onto the closure. The engaging or gripping means can be realised, for example, by barbs hooking into each other. When shutting the cover cap, barbs that are integrally formed on its inner walls slide over barbs or into recesses that are present on the outside of the closure, due to the walls of the cover cap yielding elastically towards the outside, and the barbs thus engaging in the recesses or gripping into each other and forming a solid grip connection. Instead of barbs, form elements that fit together may be integrally formed. Conventional closures with cover caps allow only weak clicking of the cover cap onto the closure for its retention in the closed position so that, with little force, this fixing can be overcome and the cover cap can be pivoted open. If a stronger grip connection is required, the question of how this can be released again to open the cover cap then arises.

FIG. 1 shows an exemplary embodiment of the closure according to the invention, with the cover cap closed, in a perspective view at an angle from above. The closure 1 is below and the cover cap 2 is above, pivoted open. The hinge 3 is located on the rear side in a known manner. As a special feature, the cover cap 2 forms a protruding push button 4 on its front side, which can be elastically pressed somewhat in the direction of the hinge 3 along with the respective front side wall of the push button 4.

FIG. 2 shows this closure with the cover cap 2 closed, viewed at an angle from below. In this view, a sleeve 5 formed on the inner side of the closure 1 is visible with its internal thread 6. Thus, the closure can be screwed onto the threaded neck of a container or a bottle. At the top, the sleeve 5 is closed by a disc 8, except for a central hole serving as a pouring or dispensing hole 7. The hinge 3 can be seen at the rear end of the closure 1 and its cover cap 2, said hinge integrally connecting the two parts 1, 2, and the respective two clamping bands 25, according to a manner known in the art.

FIG. 3 shows the closure 1 with the cover cap 2 slightly pivoted open, with a released grip of the barbs. A step 9 is formed on each of the two sides of the closure 1, onto said step the cover cap 2 can be retracted precisely with its peripheral side wall 10 so that the lower edge 11 of the side wall 10 thus rests firmly on this step 9. A recess 12 is formed above the step 9, said recess having a sharp corner 13 at the top. Barbs (not visible here) on the inner side of the side walls 10 can engage into these recesses 12 on both sides of the pouring closure 1 because the side walls 10 can give way or yield elastically towards the outside when the barbs with their inclined surfaces slide over the upper outer edge 14 of the closure 1. There is a recess 16 at the front of the closure 1, which is set back from the other outer side 15. This forms at the front of the cover cap 2 an unlocking and press point 17, here in the form of an oval push button 4, the lower half of which fits into the recess 16 as a free disc, while the upper half of the push button 4 is stiffened with the side wall 10 of the cover cap 2 and connected thereto. As can be seen in this FIG. 3, the step 9 is widened in the front region 18 of the closure 1. If the lower edge 11 of the side wall 10 of the cover cap 2 now rests firmly on the step 9 and is flush with the outer wall of the closure 1, the side wall of the cover cap can be slid inwardly on this widened step 9, by pressure on the push button 4. As a result, the two side walls 10 of the cover cap 2 bulge out laterally and the barbs integrally formed on their inner sides are moved out of the recesses 12 on the closure 1 and the grip is thus released. The cover cap 2 can be pivoted about the hinge 3 in this state.

FIG. 4 gives an insight into the closure 1 with the cover cap 2 slightly pivoted open, with a released grip of the barbs, viewed at an angle from below. The neck 19, which is integrally formed on the bottom of the cover cap 2, can be seen. Said neck has a slightly smaller diameter than the sleeve 5 at the bottom of the closure 1 and, as shown here, may be provided with a circumferential rubber seal 20 in the form of a rubber O-ring. A reinforcing rib 21 supports the stability of the neck 19 in the interior of the cover cap 2.

On the basis of FIG. 5, which shows the view of the upper side of the exposed closure and enables a view inside the cover cap 2, the significance and effect of this neck 19 is apparent. The closure 1 forms a flat surface 23, and a recess 24 is formed therein, the peripheral wall 22 of which protrudes into the sleeve 5 that is integrally formed below. The recess 24 has a bottom formed by the disc 8 as shown in FIG. 2. In the centre of this disc 8, there is the pouring hole 7. When the cover cap 2 is pivoted about the hinge 3 onto the closure 1, the neck 19 penetrates into the recess 24 on the closure 1, with its seal 20 then sealingly abutting the circumferential wall 22. This achieves very good sealing of the closure 1 when the cover cap 2 is closed and engaged with the closure.

FIG. 6 shows the closure 1 with the cover cap 2 pivoted open by 180°, viewed at an angle from below, and FIG. 7 shows it from above in a plan view. The neck 19 with the seal 20 fits into the interior of the recess 24. Instead of the neck 19 being equipped with an externally abutting seal 20, the circumferential wall 22 of the recess 24 may also bear a seal. A clamping band 25 can be seen on each of the two sides of the hinge 3 in this illustration. These clamping bands 25 ensure that the cover cap 2 can be closed beyond a maximum tension and pivoted open again, by means of a slight deformation of the entire closure 1 and its cover cap 2. This ensures that the cover cap 2 remains in its open position.

FIG. 8 shows the closure 1 with the cover cap 2 slightly pivoted open, in a central longitudinal section. In this representation, one of the barbs 26 can be seen on the inner side of the lateral wall 10 of the cover cap 2. These are elements that are wedge-shaped in their cross-section, continuously increasing in width and thickness towards the top and forming a sharp edge 27 at the top against the inside.

The operation of this closure, starting from its closed state, is best seen in FIG. 9, which shows it schematically. It is best to press on the front side of the unlocking and press point 17 with your thumb, designed here in the form of a push button, as shown indicated by the bold arrow. The unlocking and press point 17 may also be formed so that tilting is reliably prevented when actuated by centring means 29, as the FIG. 10 shows. The centring means may consist of a rib 30 behind the push button, which, when pushed, is pressed into a centring groove 31 of V-shaped cross-section on the closure and thus is centres the unlocking and press point 17 so that the lateral walls 10 of the cover cap 2 bulge outwards symmetrically, as indicated by the two small arrows in FIG. 11, and both barbs 26 are driven uniformly out of the recesses 12 on their inner sides. With continued pressing on the push button 4 or on the unlocking and press point 17, the cover cap 2 can now be pivoted upwards at the same time. It is closed, however, by simply shutting the cover cap 2 with enough pressure on its top. Thus, the barbs with their inclined surfaces 28 slide on the outer edge of the circumferential step and past the closure 1 and engage into the recesses 12 below, wherein the sharp edge 27 of each barb 26 engages with the sharp corner 13 of the respective recess 12 on the closure.

The closure is always opened using a dual action, which is still possible with a single hand, namely, pressing on a single unlocking and press point 17 firstly, that is on a single push button 4, and simultaneously pivoting the cover cap 2 open. This can be done using both hands, but is also completely possible to carry out with one single hand. This is difficult for toddlers. Furthermore, this cover cap 2 remains securely fixed on the closure 1 even when a container tips over or falls down, for example from a table to a floor. As a result, the closure remains tight even in these cases.

LIST OF REFERENCE SIGNS

1 Closure
2 Cover cap
3 Hinge
4 Push button

5 Sleeve
6 Internal thread
7 Pouring hole
8 Disc
9 step
10 Lateral wall
11 Lower edge of lateral wall 10
12 Recesses
13 Sharp corner
14 Upper outer edge
15 Outer side of the set-back recess 16
16 Set-back recess
17 Unlocking and press point
19 Neck
20 Rubber seal
21 Reinforcement rib
22 Circumferential wall
23 Level surface
24 Recess
25 Clamping bands
26 Barbs
27 Sharp rim or edge
28 Inclined surfaces
29 Centring means
30 Centring rib
31 Receiving groove for centring rib

The invention claimed is:

1. A closure (1) with a cover cap (2) which is moulded pivotably onto the closure (1) by means of a hinge (3), wherein the cover cap (2) and the closure (1) have a rear side and a front side, wherein the hinge (3) is located on the rear of the cover cap (2) and the closure (1), wherein the closure (1) and the cover cap (2) have two lateral sides between the rear side and the front side, and wherein the cover cap (2) has first grips (26) and the closure (1) has second grips (12) on the lateral sides which detachably grip to or engage between the closure (1) and the cover cap (2) at two points when shutting, wherein the cover cap (2) is deformable by pressure at the single unlocking and press point (17) so that the first grips (26) are detachable from the second grips (12) by this deformation and the cover cap (2) can be pivoted open beyond the second grips with one hand in the event of continued pressure.

2. The closure (1) with a cover cap (2) according to claim 1, wherein the first grips (26) and second grips (12) are integrally formed in the closure (1) and the cover cap (2) wherein the first grips (26) and the second grips (12), when shutting the cover cap (2) grip into each other, and wherein, when exerting pressure on the single unlocking and press point (17), the lateral sides of the cover cap (2) can bulge out towards the outside, and the first grips (26) and second grips (12) are thereby detachable.

3. The closure (1) with a cover cap (2) according to claim 1, wherein the first grips (26), which are barbs, and second grips (12), which are recesses, are integrally formed in the closure (1) and the cover cap (2), wherein the first grips (26) and second grips (12) which when shutting the cover cap (2) grip into each other, due to the barbs (27) on the cover cap (2) giving way to the outside when the cover cap (2) bulges transversely to the closing direction and thus being slidable over the recesses on the closure (1) and hereafter engaging on these recesses through the elastic reversal of the bulging, whereby the cover cap (2) is fixed onto the closure (1) in a sealing and secure manner, and in that the lateral sides of the cover cap (2) can bulge out by pressure on the top of the unlocking and press point (17) of the cover cap (2) and that the first grips (26) and second grips (12) are detachable.

4. The closure (1) with a cover cap (2) according to claim 1, wherein the cover cap (2), using its front region, rests with its edge (11) on a step (9) on the closure (1), and this edge (9) is slidable onto the plane of the step (9), by pressing on a push button (4), designed as an unlocking and press point (17) in the direction of the hinge (3) so that a sufficient lateral bilateral bulge of the lateral edges (10) of cover cap (2) can be generated, so that the first grips (26) of the cover cap (2) can be disengaged from the second grips (12) of the closure (1), and the cover cap (10) can then be pivoted open about the first grips (26), under elastic reversal of the bulges, after releasing the pressure.

5. The closure (1) with a cover cap (2) according to claim 1, wherein the cover cap (2) is designed in one piece and the locking and opening function is based solely on the elasticity of the material in cooperation with the geometry of the closure.

6. The closure (1) with a cover cap (2) according to claim 1 wherein the cover cap (2) has a centring guide (29) at the unlocking and press point (17) so that pressure on the unlocking and press point (17) can only be applied symmetrically, whereby a skewed pushing and bulging, which would release only one side of the locking, is avoidable.

7. The closure (1) with a cover cap (2) according to claim 6, wherein the centring guide (29) consists of a rib (30) integrally formed behind the press point (17) that can be pushed into a centring groove (31) with a V-shaped cross-section on the closure (1).

8. The closure (1) with a cover cap (2) according to claim 2, wherein the first grips (26) and the second grips (12) are barbs.

9. The closure (1) with a cover cap (2) according to claim 2, wherein the first grips (26) are barbs and the second grips (12) are recesses.

10. A closure (1) with a cover cap (2) having a front region which is moulded pivotably onto the closure (1) including a step (9) by means of a hinge (3), wherein the cover cap (2) and the closure (1) have a rear side and a front side, the front side having an edge (11), wherein the hinge (3) is located on the rear side of the cover cap (2) and the rear side of the closure (1), wherein the closure (1) and the cover cap (2) have two lateral sides between the rear side and the front side, and wherein the cover cap (2) has first grips (26) and the closure (1) has second grips (12) on the lateral sides which detachably grip to or engage between the closure (1) and the cover cap (2) at two points when shutting, wherein the cover cap (2) is deformable by pressure at a single unlocking and press point (17) so that the first grips (26) are detachable from the second grips (12) by and wherein edge (11) of cover cap (2) rests on step (9), and edge (11) is slidable onto the plane of the step (9), by pressing a push button (4), designed as an unlocking and press point (17) in the direction of the hinge (3) so that a sufficient lateral bilateral bulge of lateral edges (10) of cover cap (2) can be generated, and the first grips (26) can be disengaged from the second grips (12), and the cover cap (10) can then be pivoted open about the first grips (26), under elastic reversal of the bulges, after releasing the pressure.

11. The closure (1) with a cover cap (2) according to claim 10, wherein the cover cap (2) has a centring guide (29) at the unlocking and press point (17) so that pressure on the unlocking and press point (17) can only be applied symmetrically, whereby a skewed pushing and bulging, which would release only one side of the locking, is avoidable.

12. The closure (1) with a cover cap (2) according to claim 11, wherein the centring guide (29) consists of a rib (30)

integrally formed behind the press point (17) that can be pushed into a centring groove (31) with a V-shaped cross-section on the closure (1).

* * * * *